US011965278B2

(12) United States Patent
Lv et al.

(10) Patent No.: US 11,965,278 B2
(45) Date of Patent: Apr. 23, 2024

(54) DETERGENT ADDITIVE BOX AND MOUNTING STRUCTURE THEREOF, AND DISTRIBUTION BOX

(71) Applicants: CHONGQING HAIER DRUM WASHING MACHINE CO., LTD., Chongqing (CN); HAIER SMART HOME CO., LTD., Shandong (CN)

(72) Inventors: Peishi Lv, Shandong (CN); Baozhen Cheng, Shandong (CN); Tao Huang, Shandong (CN)

(73) Assignees: CHONGQING HAIER DRUM WASHING MACHINE CO., LTD., Chongqing (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 17/887,935

(22) Filed: Aug. 15, 2022

(65) Prior Publication Data

US 2022/0389638 A1 Dec. 8, 2022

Related U.S. Application Data

(63) Continuation of application No. 16/605,986, filed as application No. PCT/CN2018/083265 on Apr. 17, 2018, now Pat. No. 11,441,255.

(30) Foreign Application Priority Data

Apr. 17, 2017 (CN) ..... 201710249311.5
Apr. 17, 2017 (CN) ..... 201710249321.9
(Continued)

(51) Int. Cl.
*D06F 39/02* (2006.01)

(52) U.S. Cl.
CPC ..... *D06F 39/02* (2013.01)

(58) Field of Classification Search
None
See application file for complete search history.

(56) References Cited

U.S. PATENT DOCUMENTS

2006/0162392 A1 7/2006 Kwon et al.
2006/0272359 A1 12/2006 Kang
(Continued)

FOREIGN PATENT DOCUMENTS

CN 2292106 Y 9/1998
CN 1873084 A 12/2006
(Continued)

OTHER PUBLICATIONS

Espacenet translation CN106436188A Detergent bottle, detergent dropping device used for washing machine and washing machine, Ban (Year: 2017).*
(Continued)

*Primary Examiner* — Cristi J Tate-Sims
(74) *Attorney, Agent, or Firm* — BUCHANAN INGERSOLL & ROONEY PC

(57) ABSTRACT

Disclosed is a detergent additive box. The detergent additive box is a closed box structure having a cavity inside. The detergent additive box is provided with a one-way ventilation valve and a liquid outlet. An on-off valve is arranged on the liquid outlet. A suction device is arranged in the detergent additive box. An inlet of the suction device is communicated with the cavity, and an outlet of the suction device is communicated with an inlet of the on-off valve. The detergent additive box of the present disclosure cooperates with a switching mechanism of a washing machine and a feeding pipeline of the washing machine to realize automatic drainage and multi-time drainage, so that the detergent additive box does not need to be mounted at each time of washing.

17 Claims, 12 Drawing Sheets

(30) Foreign Application Priority Data

Apr. 17, 2017 (CN) ..... 201710250048.1
Apr. 17, 2017 (CN) ..... 201710250111.1
Apr. 17, 2017 (CN) ..... 201710250137.6

(56) References Cited

U.S. PATENT DOCUMENTS

| | | | | |
|---|---|---|---|---|
| 2007/0056328 | A1 | 3/2007 | Song | |
| 2008/0078211 | A1 | 4/2008 | Je et al. | |
| 2009/0285644 | A1 | 11/2009 | Hecht | |
| 2010/0161143 | A1* | 6/2010 | Smith | D06F 39/022 700/283 |
| 2011/0154865 | A1 | 6/2011 | Lee et al. | |
| 2011/0277515 | A1 | 11/2011 | Doh | |
| 2012/0096901 | A1 | 4/2012 | Zattin et al. | |
| 2012/0312841 | A1 | 12/2012 | Hwang | |
| 2014/0102153 | A1 | 4/2014 | Lee et al. | |
| 2016/0258106 | A1* | 9/2016 | Kim | D06F 39/022 |
| 2016/0289883 | A1 | 10/2016 | Lv et al. | |
| 2020/0040510 | A1 | 2/2020 | Lv et al. | |
| 2020/0248353 | A1 | 8/2020 | Park et al. | |
| 2021/0189629 | A1 | 6/2021 | Jung et al. | |

FOREIGN PATENT DOCUMENTS

| | | | |
|---|---|---|---|
| CN | 1978743 | A | 6/2007 |
| CN | 101153449 | A | 4/2008 |
| CN | 101307557 | A | 11/2008 |
| CN | 101381939 | A | 3/2009 |
| CN | 102108619 | A | 6/2011 |
| CN | 102282306 | A | 12/2011 |
| CN | 102421958 | A | 4/2012 |
| CN | 102660858 | A | 9/2012 |
| CN | 102713044 | A | 10/2012 |
| CN | 103276564 | A | 9/2013 |
| CN | 203795188 | U | 8/2014 |
| CN | 104652098 | A | 5/2015 |
| CN | 204919107 | U | 12/2015 |
| CN | 105350261 | A | 2/2016 |
| CN | 105887423 | A | 8/2016 |
| CN | 106222957 | A | 12/2016 |
| CN | 106245277 | A | 12/2016 |
| CN | 106319876 | A | 1/2017 |
| CN | 106436188 | A | 2/2017 |
| DE | 3236486 | A1 | 5/1983 |
| DE | 3701118 | A1 | 7/1988 |
| DE | 3715832 | A1 | 11/1988 |
| EP | 0020252 | A1 | 12/1980 |
| EP | 2048275 | A1 | 4/2009 |
| JP | 2000237497 | A | 9/2000 |
| JP | 2004313318 | A | 11/2004 |
| JP | 2011030916 | A | 2/2011 |
| KR | 20050052137 | A | 6/2005 |
| KR | 20110005262 | A | 1/2011 |
| KR | 20140047428 | A | 4/2014 |
| KR | 20140131809 | A | 11/2014 |
| WO | 2016078714 | A1 | 5/2016 |

OTHER PUBLICATIONS

Office Action issued by the U.S. Patent and Trademark Office in the U.S. Appl. No. 17/886,840, dated Mar. 2, 2023, U.S. Patent and Trademark Office, Alexandria, VA. (13 pages).

Espacenet translation CN106436188A Detergent bottle, detergent dropping device used for washing machine and washing machine (Year: 2017).

International Search Report (PCT/ISA/210) and Written Opinion (PCT/ISA/237) dated Jul. 23, 2018, by the Chinese Patent Office as the International Searching Authority for International Application No. PCT/CN2018/083265 (English translations enclosed).

* cited by examiner

DETERGENT ADDITIVE BOX AND MOUNTING STRUCTURE THEREOF, AND DISTRIBUTION BOX

TECHNICAL FIELD

The present disclosure relates to the field of washing machines, and more particularly relates to a detergent additive box capable of cooperating with a washing machine to realize automatic adding and multi-time adding and a mounting structure thereof, and a distribution box.

BACKGROUND

In a traditional washing machine, a detergent used in a washing process and the washing machine are separately placed, and no adding device for the detergent is arranged on the washing machine, so that the detergent cannot be automatically added, and this structure may not implement a full-automatic washing control process of the washing machine. With the improvement of the automation of washing machines, most washing machines are set as connecting a detergent box for placing a detergent and/or a softener with a water inlet pipeline, so that the detergent and/or softener in the detergent box may be flushed into a washing drum via inflow water. However, via this structure, the detergent and/or softener must be put into the detergent box firstly at each time of washing, which does not realize the full-automatic washing control process, either.

At present, there are a large number of patent applications related to automatic detergent adding devices. The Chinese Patent Application CN 97208723.0 discloses a detergent adding device of a washing machine. An accommodating cavity matched with a bottle is arranged on a case body of the washing machine. A conical through hole is formed in the bottom of the accommodating cavity. A vertical fixing sheet is fixed on the through hole, and fixes a detergent guide pipe. A bottle body is matched with the accommodating cavity. A conical introduction pipe is arranged at a bottle neck. A ventilation port is formed in the bottom of the bottle body. This structure cannot control the adding amount of a detergent and is easy to damage, thus wasting the detergent.

The Chinese Patent Application CN 200610136059.9 discloses a detergent supply device of a washing machine having a detergent box with a siphon unit. A detergent is injected into the detergent box, and washing water is injected into the detergent box to dilute the detergent in the box, and then the detergent is fed into a washing cylinder through the siphon unit. This disclosure solves the problem that a concentrated detergent damages washed clothes as it directly enters the washing cylinder, but may not realize automatic adding and precise control of the detergent.

The Chinese Patent Application CN 200710146295.3 applied earlier by the applicant discloses a washing machine for automatically adding a detergent and a washing method. The washing machine comprises: a washing drum, a control panel including various layout control buttons, a washed clothes weight sensor, a temperature sensor arranged in the washing drum, a water hardness sensor, a washing water turbidity sensor, a detergent box and a computer board. The detergent box is composed of an upper storage box and a lower dilution box. The computer board controls an amount of the detergent from the storage box to the dilution box according to detection results of the various sensors. An upper cover of the storage box is provided with a detergent injection port, and the bottom is provided with a detergent discharging port and an electromagnetic valve for controlling the detergent discharging port to be closed and opened. The side surface of the dilution box is provided with a water injection pipe connected with a water inlet valve of the washing machine, and the bottom is provided with a siphon discharging pipe. An excitation coil of the electromagnetic valve is arranged on the upper cover of the storage box. An armature of the electromagnetic valve is connected, through a valve rod, with a conical valve plug arranged at the detergent discharging port at the bottom of the storage box. A pressure spring is arranged between the conical valve plug and the upper cover of the storage box. Although this structure can precisely control the detergent, it is complicated in structure and high in cost.

The Chinese Patent Application CN. 201610797034.7 discloses a detergent adding device of a washing machine. The detergent adding device comprises: a storage cavity, in which a special detergent box placing slot is defined. A first ejector pin and a second ejector pin which are used for puncturing a special detergent box are arranged in the special detergent box placing slot. Furthermore, the first ejector pin has a water inlet hole inside, and the second ejector pin has a water outlet hole inside. The first ejector pin and the second ejector pin are configured to puncture into the special detergent box from the end portion to allow the water inlet hole and the water outlet hole to communicate with an internal space of the special detergent box. In this disclosure, washing water enters the detergent box through the water inlet hole and is mixed with the detergent, and then flows into the washing machine through the water outlet hole. The detergent box is used only once, and a new detergent box needs to be mounted at each time of washing.

A detergent additive box for containing the detergent and the softener is generally a sealed box body at present, and the detergent is quantitatively pumped out from the box by a Venturi effect or a negative pressure effect or through a metering pump, and the like. However, as the detergent is pumped out, the air pressure in the sealed detergent additive box becomes lower and lower, which makes the detergent flow out more and more difficultly, so that a ventilation structure is needed to balance the air pressure in the detergent additive box. Meanwhile, outflow of the detergent due to toppling over, vibration and the like, and the phenomenon that external impurities and water enter the detergent additive box and pollute the detergent also need to be prevented.

In addition, after the detergent in the detergent box is fed into the washing machine, part of liquid would be easily left on the bottom wall of the detergent box, thereby causing a waste.

In view of this, the present disclosure is provided.

SUMMARY

The present disclosure aims to overcome the shortcomings in the prior art, and provides a detergent additive box. The detergent additive box cooperates with a switching mechanism of a washing machine and a feeding pipeline of the washing machine to realize automatic drainage and multi-time drainage, so that the detergent additive box does not need to be mounted at each time of washing, thereby increasing the automation level of the washing machine and facilitating the life of people.

To solve the above-mentioned technical problems, the basic idea of the technical solution of the present disclosure is as follows.

A detergent additive box is provided. The detergent additive box is a closed box structure having a cavity inside. The detergent additive box is provided with a one-way ventilation valve and a liquid outlet. An on-off valve is arranged on the liquid outlet. A suction device is arranged in the detergent additive box. An inlet of the suction device is communicated with the cavity, and an outlet of the suction device is communicated with an inlet of the on-off valve.

Preferably, the suction device extends to a bottom wall of the detergent additive box, the inlet of the suction device towards the bottom wall of the detergent additive box, and a gap is formed between the inlet of the suction device and the bottom wall of the detergent additive box for allowing liquid to pass.

In the above solution, the suction device is provided, the inlet of the suction device is arranged toward the bottom wall of the detergent additive box, and the gap is reserved between the inlet of the suction and the bottom wall of the detergent additive box for allowing liquid to pass, so that the detergent additive in the detergent additive box is sucked completely without any waste.

Preferably, a portion, corresponding to the inlet of the suction device, on the bottom wall of the detergent additive box is sunk inwards to form a groove located lower than the surface of the bottom wall of the detergent additive box. The inlet of the suction device is located in the groove, and the gap is reserved between the inlet of the suction device and a bottom wall and a side wall of the groove for allowing liquid to pass.

In the above solution, the groove formed by inwards sinking the portion, corresponding to the inlet of the suction device, on the bottom wall and located lower than the surface of the bottom wall of the detergent additive box plays a role of aggregating the detergent additive when there is a little detergent additive remaining. Furthermore, the inlet of the suction device is in the groove, so that the detergent additive may be fully used and saved as much as possible, without causing any waste. Preferably, the suction device is a hollow tubular structure with a flow channel formed internally. One end of the flow channel towards the bottom wall of the detergent additive box, and the other end is communicated with the inlet of the on-off valve. An arc-shaped reverse diversion channel is formed between an inlet and an outlet of the flow channel. A reverse point, corresponding to the inlet of the on-off valve, on the flow channel is an arc surface extended outwards.

Preferably, the radius of the arc surface is greater than that of the flow channel. In the above solution, since the reverse point, corresponding to the inlet of the on-off valve, on the flow channel is the arc surface extended outwards; it is conducive to the flowing of the detergent additive in the flow channel relative to the use of a right angle or a corner similar to the right angle at the reverse point. In the present disclosure, the arc surface at the reverse point is conducive to flowing of liquid, instead of generating intermittent flowing.

Preferably, the on-off valve comprises a drainage channel, a piston and a reset spring, and the piston and the reset spring are arranged in the drainage channel. The piston blocks the drainage channel under the action of the reset spring. Preferably, the on-off valve comprises the drainage channel and the piston arranged in the drainage channel. A gap used for allowing liquid to flow is reserved between the outer wall of the piston and the inner wall of the drainage channel. The outlet end of the drainage channel is provided with a narrowed section. The piston squeezes the narrowed section under the action of the reset spring to close the drainage channel. Preferably, the liquid outlet is communicated with the feeding pipeline of the washing machine to deliver the detergent additive into the washing chamber of the washing machine. A communicating structure is arranged on the feeding pipeline, and is used for opening the on-off valve when the liquid outlet is communicated with the feeding pipeline.

In the above solution, the communicating structure is set as a protruding structure or has a protruding structure. The protruding structure is inserted into the liquid outlet and cooperate with the piston when opening the on-off valve 5. The protruding structure pushes away the piston to open the on-off valve.

Preferably, the communicating structure is arranged at the end portion of the feeding pipeline, and opens the on-off valve via pushing the piston. A sealing ring is arranged in the liquid outlet or the drainage channel of the on-off valve, and is used for sealing a joint of the liquid outlet and the feeding pipeline.

In the above solution, the communicating structure is a columnar structure, in which a flow channel is formed. One end of the communicating structure cooperates with the detergent additive box to open the on-off valve, and the other end is communicated with the feeding pipeline of the washing machine. A hole communicating with the flow channel in the communicating structure is formed in the side wall of the end cooperating with the detergent additive box, and when the end portion pushes away the piston, the detergent additive is delivered by the hole into the flow channel of the communicating structure, and then enters the washing machine through the feeding pipeline.

Preferably, the detergent additive box is a cube or cuboid structure, and the liquid outlet is arranged flush with an outer surface of the detergent additive box. Certainly, the liquid outlet may also protrude from the surface of the detergent additive box. However, in order to reduce the machining difficulty and simplify the structure of a mounting cavity for accommodating the detergent additive box, the detergent additive box is preferably designed to be a regular cube or cuboid, and the liquid outlet is flush with the outer surface of the detergent additive box.

Preferably, the liquid outlet is formed in the side wall of the detergent additive box, and the communicating structure is horizontally arranged corresponding to the liquid outlet.

Or, the liquid outlet is formed in the bottom wall of the detergent additive box, and the communicating structure is vertically arranged corresponding to the liquid outlet.

Preferably, the one-way ventilation valve comprises a ventilation element and an opening and closing element. An air vent is provided in the ventilation element. The opening and closing element comprises an opening and closing portion. The air vent is open for one-way ventilation or is closed when the opening and closing portion is opened or closed according to changes of air pressures on two sides of the detergent additive box.

Through the adoption of the above technical solutions, the present disclosure has the following technical effects.

The detergent additive box of the present disclosure cooperates with the switching mechanism of the washing machine and the feeding pipeline of the washing machine to realize the automatic drainage and the multi-time drainage, so that the detergent additive box does not need to be mounted at each time of washing. In the present disclosure, the suction device is also arranged in the detergent additive box. One end of the suction device extends into the bottom of the cavity, and the other end is communicated with the inlet of the on-off valve. The portion, corresponding to the inlet of the suction device, on the bottom wall of the detergent additive box is sunk inwards to form the groove located lower than the surface of the bottom wall of the detergent additive box. The inlet of the suction device is located in the groove, so that it is conducive to the suction device to suck the detergent additive fully, and waste is prevented. On the other hand, the flow channel is formed in the suction device, and the reverse point, corresponding to the inlet of the on-off valve, of the flow channel is an outwards extended arc, so that this structural design is conducive to flowing of liquid in the flow channel to achieve a continuous and smooth drainage effect, instead of generating intermittent drainage.

The specific implementation modes of the present disclosure are further described below in detail in combination with the accompanying drawings.

BRIEF DESCRIPTION OF DRAWINGS

The drawings constitute one part of this application, and are used to provide a further understanding of the present disclosure. Illustrative embodiments and descriptions thereof of the present disclosure are used to explain the present disclosure, and do not constitute an improper limitation to the present disclosure. Obviously, the drawings described below are only some embodiments, and those skilled in the art can obtain other drawings according to these drawings without paying any creative work. In the drawings.

Figure 1:
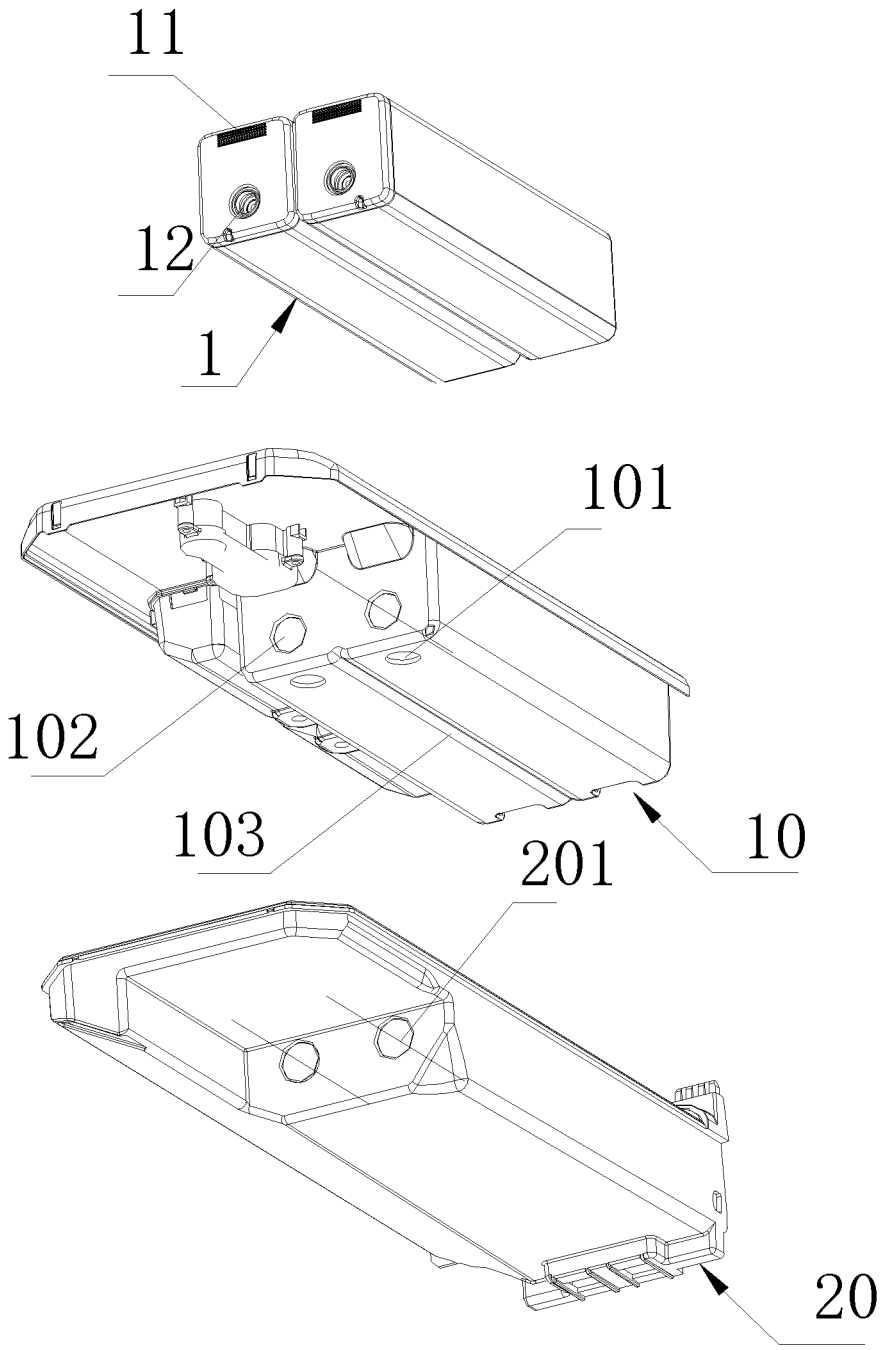
FIG. 1 is an exploded diagram of a mounting structure of a detergent additive box of the present disclosure.
Figure 2:
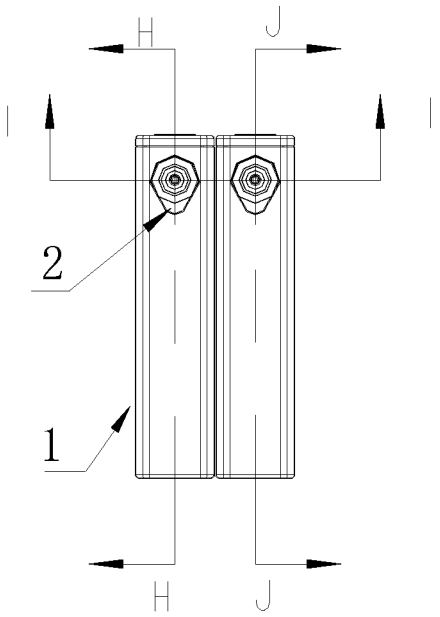
FIG. 2 is a top view of a detergent additive box of the present disclosure.
Figure 3:
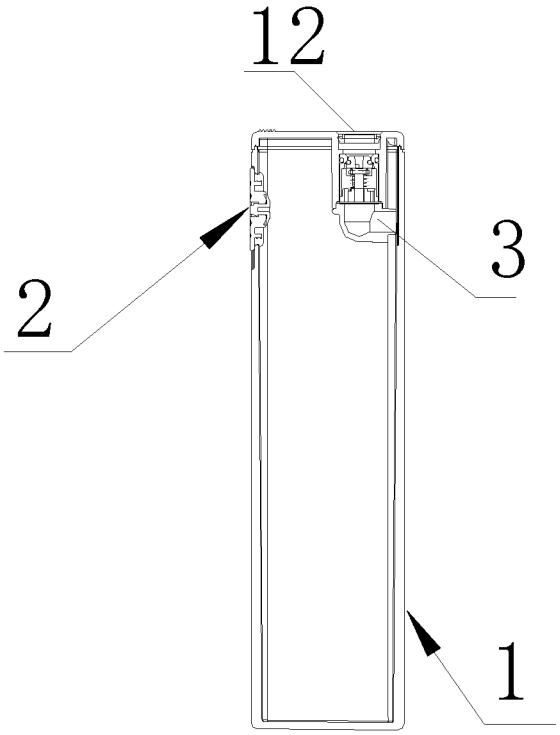
FIG. 3 is a cross-sectional diagram along H-H of FIG. 2.
Figure 4:
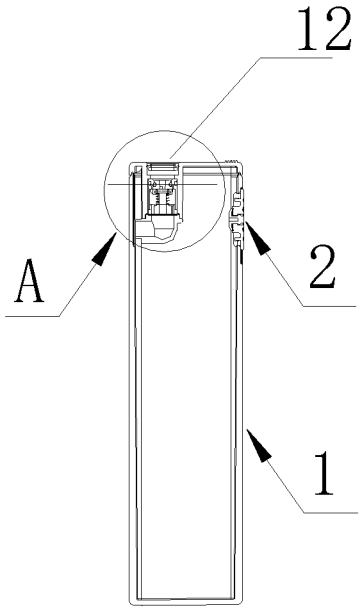
FIG. 4 is a cross-sectional diagram along J-J of FIG. 2.
Figure 5:
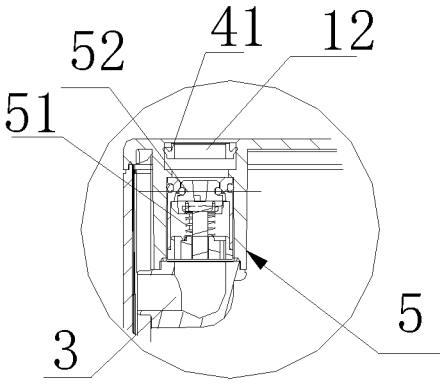
FIG. 5 is an enlarged diagram of a portion A of FIG. 4.
Figure 6:
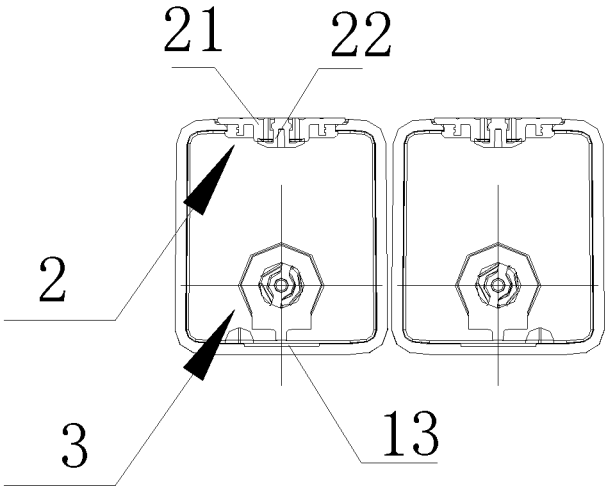
FIG. 6 is a cross-sectional diagram along I-I of FIG. 2.

In the drawings: 1: detergent additive box; 11: protruding structure; 12: liquid outlet; 13: groove; 2: one-way ventilation valve; 21: ventilation element; 211: air vent; 212: connection hole; 2121: locking boss; 213: ring groove; 22: opening and closing element; 221: opening and closing portion; 222: connection portion; 2221: ring convex plate; 2222: transition section; 2223: hollow hole; 3: suction device; 41: sealing ring; 5: on-off valve; 51: reset spring; 52: piston; 10: upper-layer box; 101: through hole; 102: avoiding opening; 103: separation rib; 20: lower-layer box; 201: avoiding opening; 14: liquid inlet; 141: guide portion; 15: mounting recess; 2': liquid inlet cover; 21': first cover body; 211': air vent; 212': connection hole; 2121': locking boss; 213': ring groove; 214': recess; 215': connection portion; 22': opening and closing element; 221': opening and closing portion; 222': connection transition section; 2221': ring convex plate; 2223': hollow hole; 23': second cover body; 231': groove; 232': transition portion; 202: mounting cavity; 203: digging position; 204: elastic member; 205: stop portion; 206: single-use feeding chamber; 6: feeding funnel; 61: siphon cap; and 62: siphon column.

It should be noted that these drawings and text descriptions are not intended to limit the conceptual scope of the present disclosure in any form, but are to describe the concept of the present disclosure to those skilled in the art with reference to specific embodiments.

DETAILED DESCRIPTION

In order to make the objectives, technical solutions and advantages of the embodiments of the present disclosure clearer, the technical solutions in the embodiments will be described clearly and completely below in conjunction with the drawings in the embodiments of the present disclosure. The following embodiments are used to describe the present disclosure, but not intended to limit the scope of the present disclosure.

In the description of the present disclosure, it should be noted that orientations or positional relationships indicated by the terms "upper", "lower", "inside", "outside" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are construed as limiting the present disclosure.

The present disclosure provides a detergent additive box 1. The detergent additive box 1 is a closed box structure having a cavity inside. The detergent additive box is provided with a one-way ventilation valve 2 and a liquid outlet 12. An on-off valve 5 is arranged on the liquid outlet 12. A suction device 3 is also arranged in the detergent additive box 1. An inlet of the suction device 3 is communicated with the cavity, and an outlet of the suction device 3 is communicated with an inlet of the on-off valve 5.

Embodiment I

In Embodiment I, referring to FIGS. 1 to 6, the suction device 3 extends to a bottom wall of the detergent additive box 1, and the inlet of the suction device 3 towards the bottom wall, and a gap used for allowing liquid to pass is reserved between the inlet of the suction 3 and the bottom wall of the detergent additive box 1.

In the present embodiment, the suction device 3 is provided, the inlet of the suction device 3 is arranged toward the bottom wall of the detergent additive box 1, and the gap is reserved between the inlet of the suction 3 and the bottom wall of the detergent additive box 1 for allowing liquid to pass, so that the detergent additive in the detergent additive box 1 is sucked completely without any waste. Preferably, a portion, corresponding to the inlet of the suction device 3, of the bottom wall of the detergent additive box 1 is sunk inwards to form a groove 13 located lower than a surface of the bottom wall of the detergent additive box 1. The inlet of the suction device 3 is in the groove 13, and a gap is formed between the inlet of the suction device 3 and a bottom wall and a side wall of the groove 13 for allowing liquid to pass. In the present embodiment, the groove 13 formed by inwards sinking the portion, corresponding to the inlet of the suction device 3, of the bottom wall and located lower than the surface of the bottom wall of the detergent additive box 1 plays a role of aggregating the detergent additive when there is a few of the detergent additive remaining. Furthermore, the inlet of the suction device 3 is in the groove 13, so that the detergent additive may be fully used and saved as much as possible, without causing any waste.

Furthermore, the suction device 3 is a hollow tubular structure with a flow channel formed internally. One end of the flow channel towards the bottom wall of the detergent additive box 1, and the other end of the flow channel is communicated with the inlet of the on-off valve 5. An arc-shaped reverse diversion channel is formed between an inlet and an outlet of the flow channel. A reverse point, corresponding to the inlet of the on-off valve 5, of the flow channel is an arc surface extended outwards. Preferably, the radius of the arc surface is greater than that of the flow channel. Since the reverse point, corresponding to the inlet of the on-off valve 5, of the flow channel is the arc surface extended outwards; it is conducive to the flow of the detergent additive in the flow channel relative to the use of a right angle or a corner similar to the right angle at the reverse point. In the present disclosure, the arc surface extended outwards at the reverse point is conducive to flowing of liquid, instead of generating intermittent flowing.

Preferably, the on-off valve 5 comprises a drainage channel, a piston 52 and a reset spring 51, the piston 52 and the reset spring 51 are arranged in the drainage channel. The piston 52 blocks the drainage channel under the action of the reset spring 51.

Preferably, the on-off valve 5 comprises the drainage channel and the piston 52 arranged in the drainage channel. A gap is formed between the outer wall of the piston 52 and the inner wall of the drainage channel for flow passage. The outlet end of the drainage channel is provided with a narrowed section. The piston 52 squeezes the narrowed section under the action of the reset spring 51 to close the drainage channel. Preferably, the liquid outlet 12 is communicated with the feeding pipeline of the washing machine to add the detergent additive into the washing chamber of the washing machine. A communicating structure is arranged on the feeding pipeline, and is used for opening the on-off valve 5 when the liquid outlet 12 is communicated with the feeding pipeline.

In the present embodiment, the communicating structure is set as a protruding structure or has a protruding structure. The protruding structure is inserted into the liquid outlet 12 and cooperate with the piston 52 when opening the on-off valve 5. The protruding structure pushes away the piston 52 to open the on-off valve 5. Preferably, the communicating structure is arranged at the end portion of the feeding pipeline, and opens the on-off valve 5 via pushing the piston 52. A sealing ring 41 is arranged in the liquid outlet 12 or the drainage channel of the on-off valve 5, and is used for sealing a joint of the liquid outlet 12 and the feeding pipeline.

In the above solution, the communicating structure is a columnar structure, in which a flow channel is formed. One end of the communicating structure cooperates with the detergent additive box 1 to open the on-off valve 5, and the other end is communicated with the feeding pipeline of the washing machine. A hole communicating with the flow channel in the communicating structure is formed in the side wall of the end cooperating with the detergent additive box 1, and when the end portion pushes away the piston 52, the detergent additive is delivered through the hole into the flow channel of the communicating structure, and then enters the washing machine through the feeding pipeline.

Preferably, the detergent additive box 1 is a cube or cuboid structure, and the liquid outlet 12 is arranged flush with an outer surface of the detergent additive box 1. Certainly, the liquid outlet 12 may also protrude from the surface of the detergent additive box 1. However, in order to reduce the machining difficulty and simplify the structure of a mounting cavity 202 for accommodating the detergent additive box 1, the detergent additive box 1 is preferably designed to be a regular cube or cuboid, and the liquid outlet 12 is flush with the outer surface of the detergent additive box 1.

Embodiment II

In the present embodiment, the liquid outlet 12 of the detergent additive box 1 is arranged on the side wall of the detergent additive box 1. The washing machine is provided with a water box in which a distribution box which is capable of withdrawable/pushable is arranged. A mounting cavity 202 is arranged on the distribution box. The detergent additive box 1 is mounted in the mounting cavity 202. A communicating structure is arranged in the water box, and when the distribution box is pushed into the water box, the communicating structure opens the on-off valve 5 to enable the cavity to communicate with the feeding pipeline.

The liquid outlet 12 is arranged at the bottom position of the side wall of the detergent additive box 1, and the suction device 3 is a horizontally arranged hollow tubular structure. The arrangement of the liquid outlet 12 at the bottom position of the side wall is conducive to completely suck the detergent additive in the detergent additive box 1 via suction device 3.

Or, the liquid outlet 12 is arranged at any position of the side wall of the detergent additive box 1, and the suction device 3 is a hollow tubular structure with the inlet end bent to one side of the bottom wall of the detergent additive box 1. The inlet of the suction device 3 towards the bottom wall of the detergent additive box 1, and a gap is formed between the inlet and the bottom wall for allowing liquid to pass. In this solution, the inlet of the suction device 3 towards the bottom wall of the detergent additive box 1, and the gap for allowing liquid to pass is reserved between the inlet and the bottom wall. The gap is as small as possible, which is conducive to the suction device 3 to suck the detergent additive in the detergent additive box 1 fully.

Further, at least one placement space for placing the detergent additive box 1 is provided inside the mounting cavity 202. A limiting structure is arranged on the mounting cavity 202, and is used for limiting the movement of the detergent additive box 1 when the detergent additive box 1 is arranged in the mounting cavity 202.

The limiting structure comprises an elastic member 204 arranged on one side of the mounting cavity 202, and the elastic member 204 is arranged between the detergent additive box 1 and the side wall of the mounting cavity 202 in an elastic deformation manner when the detergent additive box 1 is arranged in the mounting cavity 202. Preferably, the detergent additive box 1 is a cuboid structure, and the elastic member 204 is disposed along a lengthwise direction of the detergent additive box 1.

Preferably, detergent additive boxes 1 are provided and parallel disposed to each other in the mounting cavity. The limiting structure further comprises at least one separation rib arranged on the bottom wall of the mounting cavity 202 to form the separate spaces for placing the detergent additive boxes.

Preferably, the separation rib 103 and the elastic member 204 are arranged in the same direction. The separation rib 103 limits the movement of the detergent additive box 1 in a first direction, and the elastic member 204 limits the movement of the detergent additive box 1 in a second direction perpendicular to the first direction. Preferably, a digging position 203 is arranged on the side wall of the side, opposite to the elastic member 204, of the mounting cavity 202. Preferably, the digging position 203 is a recess extending from the side wall of the mounting cavity 202 to the outside of the mounting cavity 202. A protruding structure 11 for increasing friction force is arranged at a position, corresponding to the digging position 203, of the detergent additive box 1. The detergent additive box 1 is further convenient to be removed by the user via the protruding structure. Preferably, the protruding structure comprises a plurality of protruding ribs arranged on the side surface of the detergent additive box 1 in parallel.

Further, the distribution box comprises an upper-layer box 10 and a lower-layer box 20, the upper-layer box 10 and the lower-layer box 20 are detachably arranged/integrated. The lower-layer box 20 is connected with a drainage structure communicating with an outer drum of the washing machine. The mounting cavity 202 is arranged on the upper-layer box 10. A through-hole 101 communicating with the lower-layer box 20 is formed on the bottom wall of the mounting cavity 202. The user cleans the mounting cavity 202 conveniently via the through-hole 101. Specifically, the detergent additive may possibly leak from the liquid outlet 12 of the detergent additive box 1 to the mounting cavity 202 in long-time use, in by now, the mounting cavity 202 is flushed with water, and the flushing water enters the lower-layer box 20 through the through hole 101 and then flow into the washing machine, thereby achieving the aim of cleaning the mounting cavity 202. The communicating structure is arranged in the water box. An avoiding opening 102 is formed at a position, opposite to the liquid outlet 12, in the mounting cavity 202 of the upper-layer box 10. And an avoiding opening 201 is also formed at a position, corresponding to the avoiding opening 102, of the lower-layer box. The on-off valve is opened for connecting the cavity of the detergent additive box 1 with the feeding pipeline via the communicating structure arranged on the water box passes through the avoiding opening 201 and the avoiding opening 102 in sequence to cooperate with the liquid outlet when the distribution box is pushed into the water box. A negative pressure generator is arranged in the water box, and is used for pumping the liquid in the detergent additive box into the washing machine. A negative pressure generator is also arranged in the water box, and is used for pumping the liquid in the detergent additive box into the washing machine. Preferably, a stop portion 205 is arranged on the upper-layer box 10, and cooperates with the water box of the washing machine to limit the distribution box from being separated from the water box.

Figure 16:
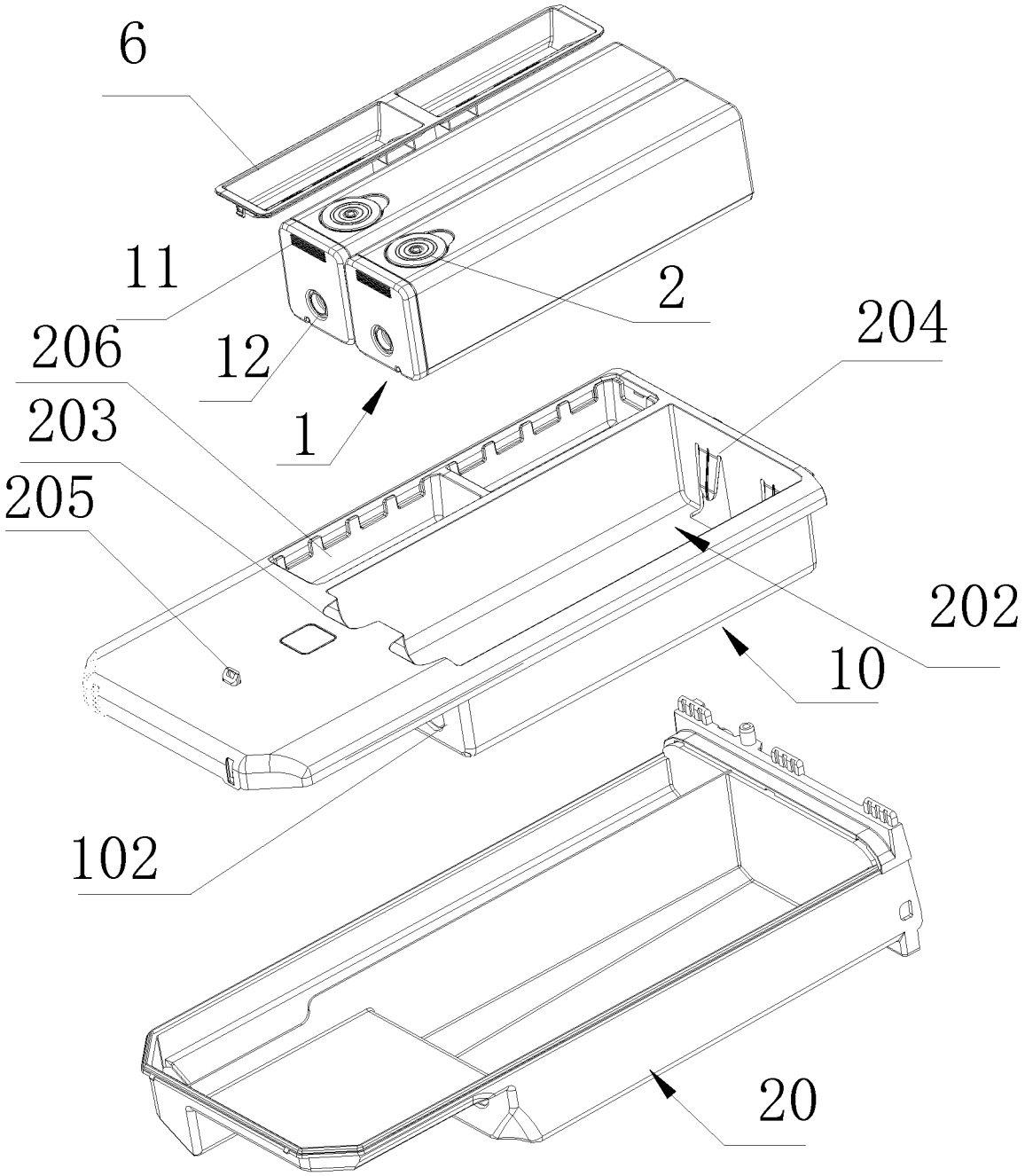
FIG. 16 is a structural schematic diagram of a distribution box and a detergent additive box in Embodiment II of the present disclosure.
Figure 17:
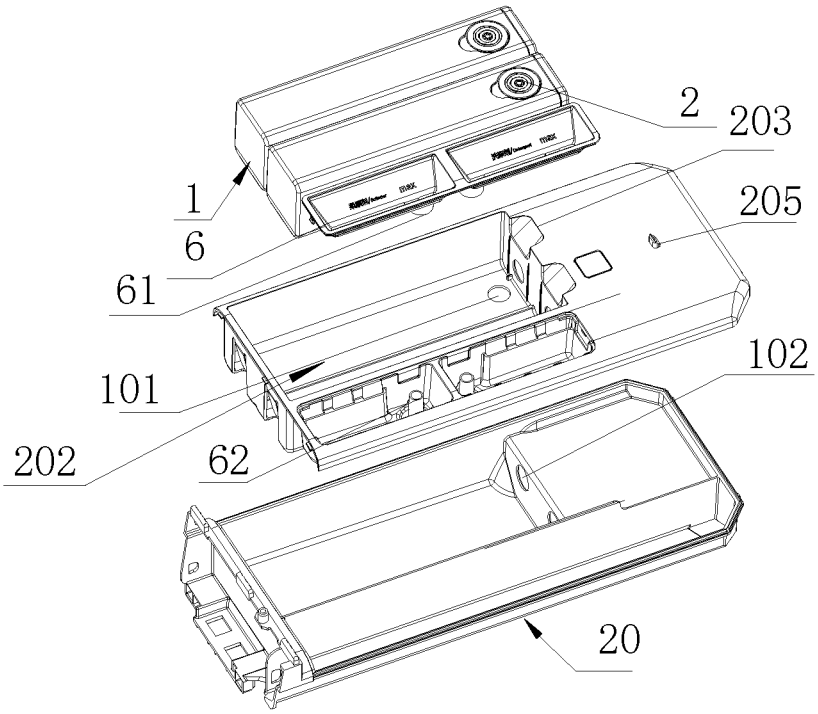
FIG. 17 is another structural schematic diagram of a distribution box and a detergent additive box in Embodiment II of the present disclosure.

Preferably, referring to FIGS. 16 and 17, a single-use feeding chamber 206 is arranged on the upper-layer box, and a siphon structure is arranged in the single-use feeding chamber 206.

In the above solution, by the arrangement of the single-use feeding chamber 206, the distribution box of the present disclosure is not limited to feeding the detergent additive via the detergent additive box 1, and may also directly deliver the detergent additive for one time by using the single-use feeding chamber 206. If the user only needs to use one detergent to wash clothes for one time, and is not sure whether to use the same detergent at the next time, the user may pour the detergent additive into the single-use feeding chamber 206 to complete the single washing, which is simple and fast.

Preferably, the single-use feeding chamber 206 is adjacent to the mounting cavity 202. The open end of the single-use feeding chamber 206 is provided with a feeding funnel 66. An outlet of the feeding funnel 66 is opposite to the opening of the single-use feeding chamber 206.

Preferably, the feeding funnel 66 is clamped to the top of the single-use feeding chamber 206 via a buckle structure. The feeding funnel 6 is provided with a diversion wall from the opening to the bottom. The opening is formed in the bottom of the diversion wall. The diversion wall is a structure tilting towards the inner side. In the present disclosure, two single-use feeding chamber 206 are provided, and two feeding funnels 6 are respectively provided to single-use feeding chambers. Corresponding detergent additive types is marked on the diversion walls of the feeding funnels 6. For example, "Softener" is marked on the diversion wall of the feeding funnel 6 corresponding to one single-use feeding chamber 206, and "Detergent" is marked on the diversion wall of the other feeding funnel 6 corresponding to the other single-use feeding chamber 206, thereby facilitating the use by the user.

Preferably, a siphon cap 61 is integrally arranged at the bottoms of the feeding funnel 6, and a siphon column 62 is integrally arranged at position, corresponding to the siphon cap 61, of the single-use feeding chamber 206. A diversion structure is arranged at a position, corresponding to outlet of the siphon columns 62, of the lower-layer box 20, and diverts the detergent additive into the washing machine.

In the above solution, referring to FIG. 17, the siphon cap 61 is integrally arranged at the bottom of the feeding funnel 66, and the siphon column 62 is integrally arranged at the position, corresponding to the siphon cap 61, of the single-use feeding chamber 206. This structural arrangement is conducive to cleaning the single-use feeding chamber 206. This structure is more reasonable. During cleaning, the single-use feeding chamber 206 may be flushed after the feeding funnel 6 is removed.

Preferably, a washing powder adding chamber is arranged on the upper-layer box 10, and is used for one-time adding of the washing powder for single washing. A diversion plate obliquely extending from the side wall of one side to the side wall of the opposite side is arranged in the washing powder adding chamber. A portion, corresponding to the tail end of the diversion plate, of the bottom wall of the washing powder adding chamber is provided with a washing powder outlet communicating with the lower-layer box 20. A diversion plate is arranged on the lower-layer box 20, and diverts inflow mixed with the washing powder into the washing machine.

According to the present disclosure, the mounting cavity 202 is arranged on the distribution box, and the detergent additive box 1 is quickly mounted and removed. The two structures cooperate with each other to make the mounting and removal processes of the detergent additive box 1 convenient and simple.

Preferably, in one implementation mode, a mounting cavity 202 accommodating the detergent additive box is formed via sinking inward of the table-board at the top of the washing machine. A communicating structure is horizontally arranged at a position, corresponding to the liquid outlet, in the mounting cavity 202, so that when the detergent additive box is placed in the mounting cavity 202, the communicating structure opens the on-off valve to enable the cavity of the detergent additive box to communicate with the feeding pipeline. The surface of the table-board is sunk inwards to form the mounting cavity 202. Detergent additive boxes are separately provided and placed in placement spaces in the mounting cavity 202. The detergent additive box is a cuboid/cube structure. The liquid outlet is arranged at the bottom of the cuboid/cube structure. A communicating structure is vertically arranged at a position, located on the bottom wall of the mounting cavity 202, in each placement space, and is used for opening the on-off valve to connect the liquid outlet with a detergent feeding port of the washing machine.

Embodiment III

Figure 7:
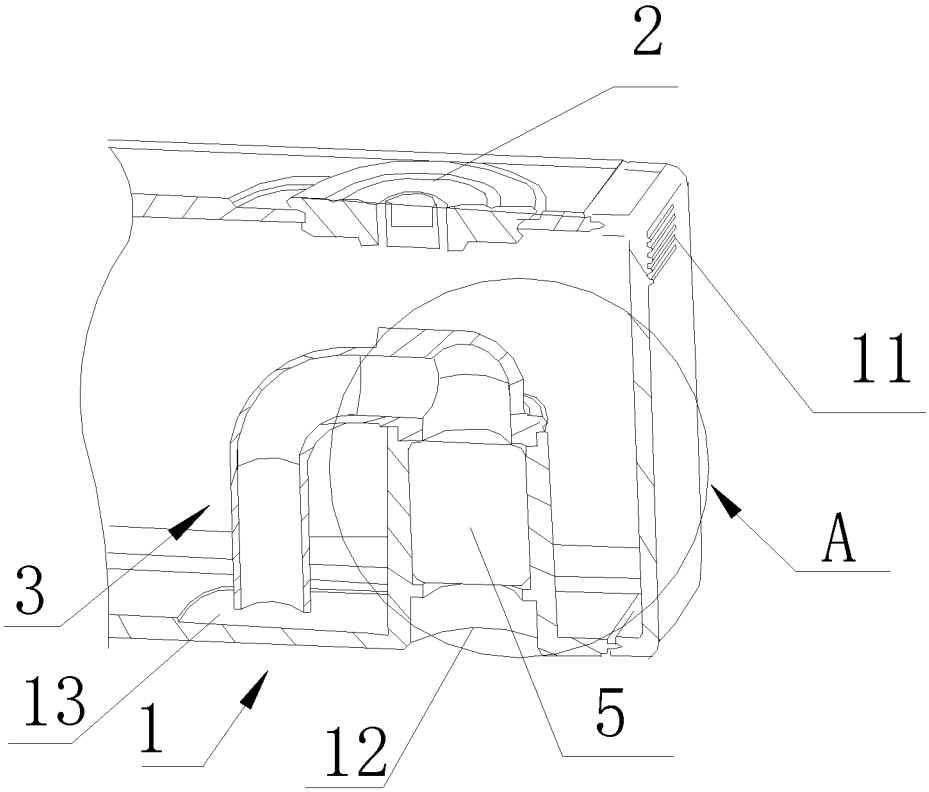
FIG. 7 is an internally structural diagram of a detergent additive box of Embodiment III of the present disclosure.
Figure 8:
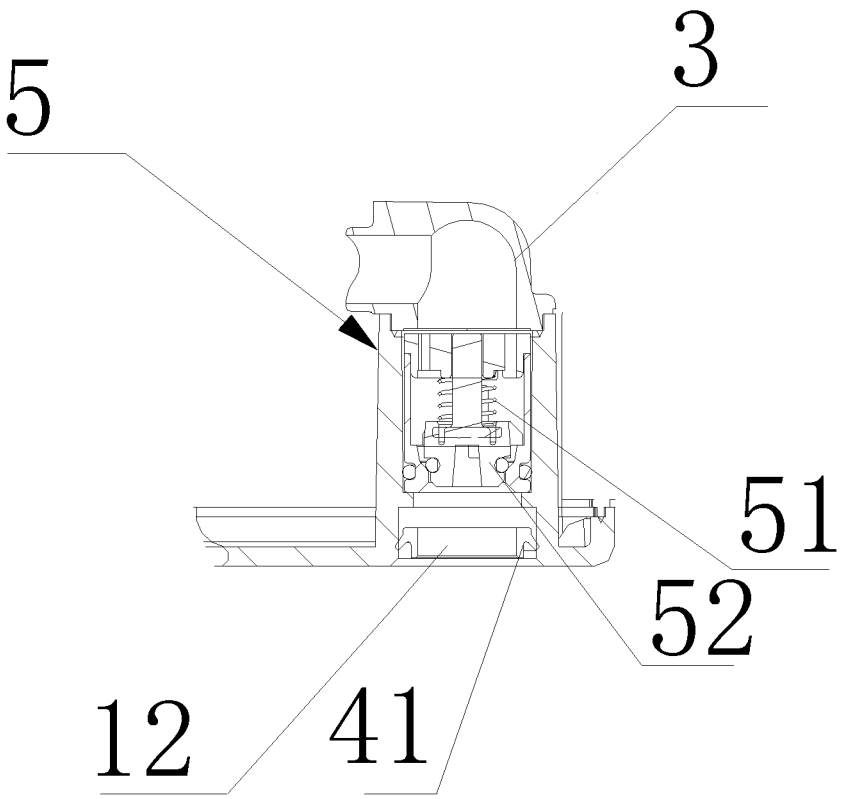
FIG. 8 is an enlarged diagram of a portion A of FIG. 7.

As shown in FIGS. 7 to 8, in the present embodiment, the liquid outlet 12 is located on the bottom wall of the detergent additive box 1, and is communicated with the feeding pipeline of the washing machine to deliver the detergent additive into the washing machine. A mounting cavity 202 for accommodating the detergent additive box 1 is arranged on the table-board at the top of the washing machine. A communicating structure is arranged at a position, corresponding to the liquid outlet 12, in the mounting cavity 202, and when the detergent additive box 1 is placed in the mounting cavity 202, the communicating structure opens the on-off valve 5 to enable the cavity of the detergent additive box 1 to communicate with the feeding pipeline.

Preferably, the on-off valve 5 is vertically arranged in the detergent additive box 1. The inlet end of the suction device 3 bends and extends to the bottom wall of the detergent additive box 1, and the inlet of the suction device 3 towards the bottom wall, and a gap is formed between the inlet of the suction device 3 and the bottom wall of the detergent additive box 1 for allowing liquid to pass. The inlet of the suction device 3 towards the bottom wall of the detergent additive box 1, and a gap is formed between the inlet and the bottom wall for allowing liquid to pass. It will be better that the distance between the inlet of the suction device and the bottom wall of the detergent additive box 1 is shorter without affecting the flowing of the liquid.

Further, the suction device 3 is a hollow tubular structure with a flow channel formed internally. One end of the flow channel towards the bottom of the detergent additive box 1, and the other end of the flow channel is communicated with an inlet of the on-off valve 5. A diversion channel for twice reversing is formed between an inlet and an outlet of the flow channel. The suction device 3 cooperates with the on-off valve 5 to form a drainage channel of an "n"-shaped structure. Preferably, a reverse point, corresponding to the inlet of the on-off valve 5, of the flow channel is an arc surface extended outwards, which is conducive to the flowing of the detergent additive in the flow channel, relative to the use of a right angle or a corner similar to the right angle at each reverse point. In the present disclosure, the reverse points are designed to be the arc surface extended outwards, which is conducive to the flowing of the fluid, instead of generating intermittent flowing.

Preferably, the two reverse points on the flow channel are both the arc surface extended outwards.

Preferably, the radius of each arc surface is greater than that of the flow channel. When the radius of each arc surface is greater than that of the flow channel, the drainage effect is better.

Preferably, a portion, corresponding to the inlet of the suction device 3, of the bottom wall of the detergent additive box 1 is sunk inwards to form a groove 13 located lower than the surface of the bottom wall of the detergent additive box 1. The inlet of the suction device 3 is located in the groove 13, and a gap is formed between the inlet of the suction device and the bottom wall and the side wall of the groove 13 for allowing liquid to pass.

Preferably, the on-off valve 5 comprises a drainage channel, a piston 52 and a reset spring 51, and the piston 52 and the reset spring 51 are arranged in the drainage channel. The piston 52 blocks the drainage channel under the action of the reset spring 51.

Preferably, the on-off valve 5 comprises the drainage channel and the piston 52 arranged in the drainage channel. A gap is formed between the outer wall of the piston 52 and the inner wall of the drainage channel for allowing liquid to pass. The outlet end of the drainage channel is provided with a narrowed section. The piston 52 squeezes the narrowed section under the action of the reset spring to close the drainage channel.

The communicating structure is vertically protruded at a bottom of the mounting cavity 202, and is inserted into the liquid outlet 12 to push the piston 52 to open the on-off valve 5 when the detergent additive box 1 is placed in the mounting cavity 202. A sealing ring 41 is arranged in the liquid outlet 12 or the drainage channel of the on-off valve 5, and is used for sealing a joint of the liquid outlet 12 and the feeding pipeline. The sealing ring 41 provided effectively prevents liquid leakage from the liquid outlet 12 of the detergent additive box 1.

Embodiment IV

The present embodiment describes the structure of the detergent additive box 1, two structures of the detergent additive box 1 are provided.

The first structure is that: referring to FIGS. 1 to 6, the liquid outlet 12 is arranged on the side wall of the detergent additive box 1, and the detergent additive box 1 is a cuboid or cube box structure. Preferably, the detergent additive box 1 is the cuboid structure, and the liquid outlet 12 is arranged on one side wall which hermetically connected with a main body of the detergent additive box 1. The on-off valve 5 is integrated with the side wall. The inlet of the on-off valve 5 hermetically is communicated with the outlet of the suction device 3.

The second structure is that: referring to FIG. 7, the detergent additive box is a regular cuboid structure, and the liquid outlet 12 is arranged on the bottom wall of the detergent additive box. The on-off valve 5 is integrated with the bottom wall and vertically disposed. One end of the suction device 3 towards the bottom wall, and the other end is reversed twice; the outlet of the suction device 3 hermetically is communicated with the inlet of the on-off valve 5. A reverse point, corresponding to the inlet of the on-off valve 5, of the flow channel is an arc surface extended outwards, which is conducive to the flowing of the detergent additive in the flow channel, relative to a right angle or a corner similar to the right angle at each reverse point. In the present disclosure, the reverse points are designed to be the outwards extended arc surfaces, which are conducive to the flowing of the fluid, instead of generating intermittent flowing. Preferably, the two reverse points in the flow channel are both the arc surface extended outwards.

Embodiment V

Figure 9:
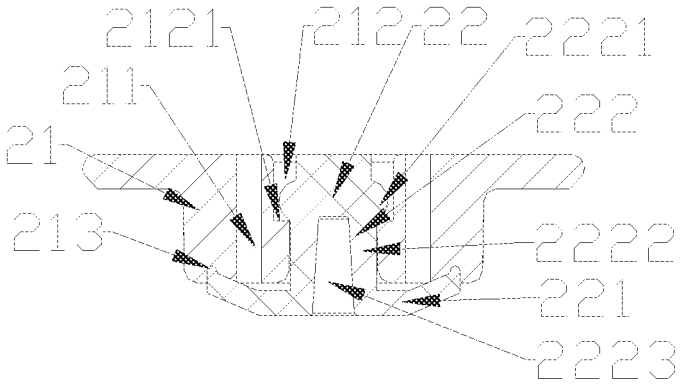
FIG. 9 is a cross-sectional schematic diagram of a one-way ventilation valve of Embodiment V of the present disclosure along A-A.
Figure 10:
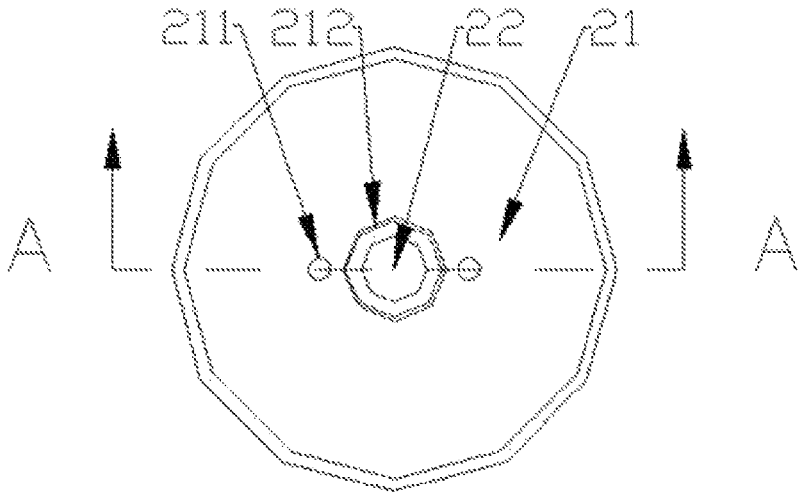
FIG. 10 is a top-view schematic diagram of the one-way ventilation valve of Embodiment V of the present disclosure.
Figure 11:
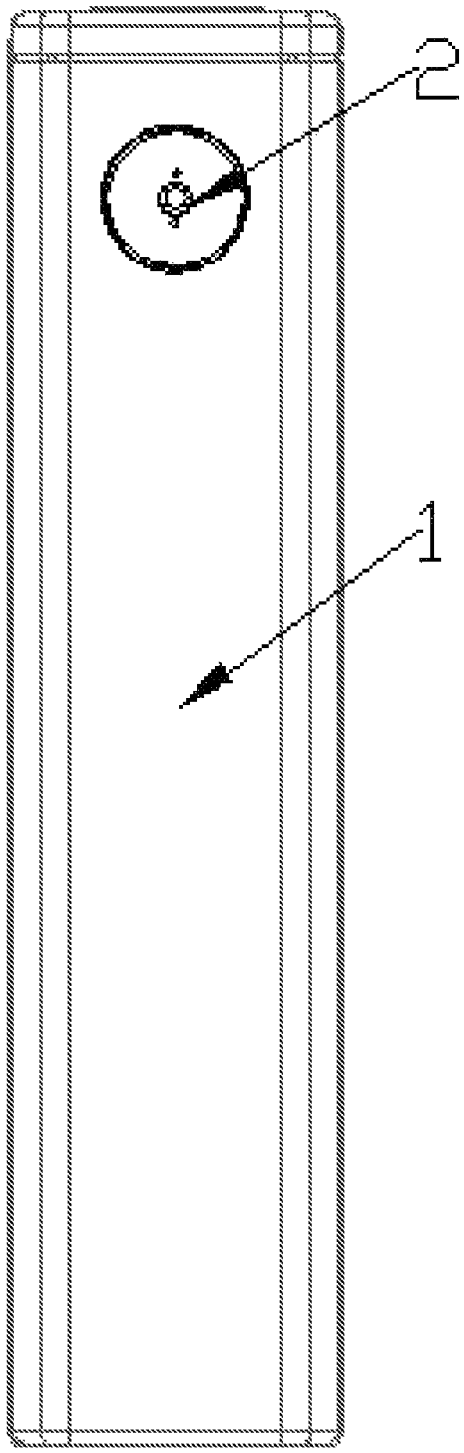
FIG. 11 is a schematic diagram of a detergent additive box of the present disclosure.
Figure 12:
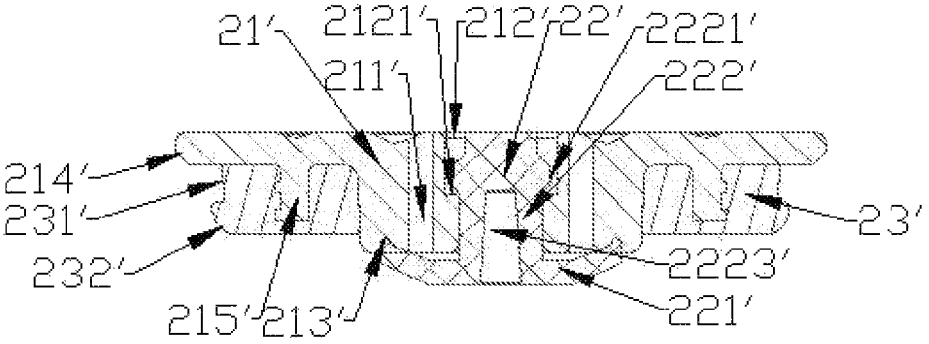
FIG. 12 is a cross-sectional diagram of a liquid inlet cover of Embodiment VI of the present disclosure along A-A.
Figure 13:
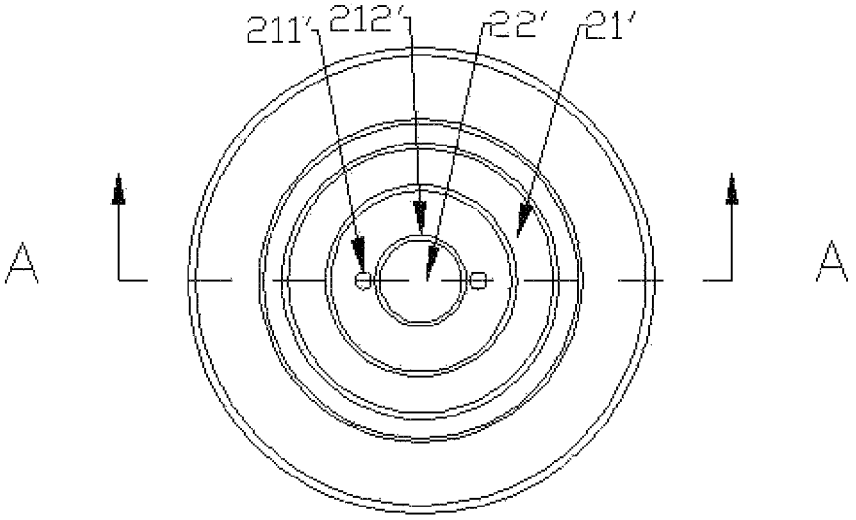
FIG. 13 is a top-view schematic diagram of a one-way ventilation structure of Embodiment VI of the present disclosure.
Figure 14:
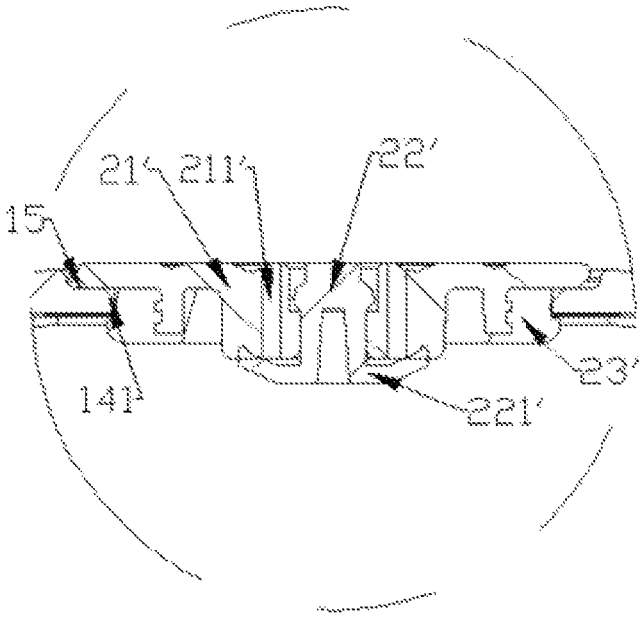
FIG. 14 is a partial schematic diagram of installation of the liquid inlet cover in Embodiment VI of the present disclosure.
Figure 15:
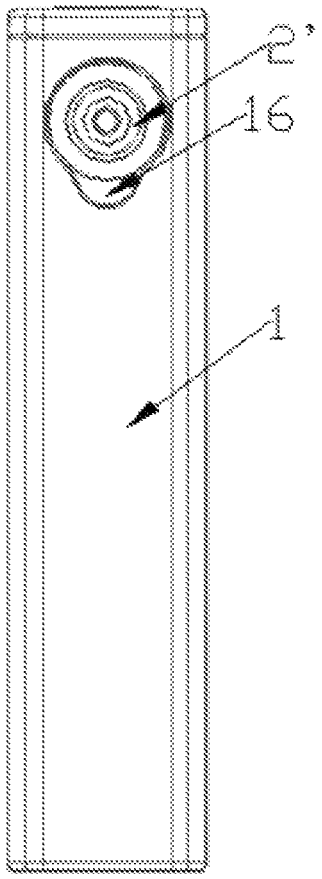
FIG. 15 is a schematic diagram of a detergent additive box in Embodiment VI of the present disclosure.

As shown in FIGS. 9 to 11, the present embodiment describes a one-way ventilation valve 2. The one-way ventilation valve 2 is mounted on the detergent additive box 1, and comprises a ventilation element 21 and an opening and closing element 22. An air vent 211 is provided on the ventilation element 21. The opening and closing element 22 comprises an opening and closing portion 221. The air vent is open for one-way ventilation or is closed when the opening and closing portion 221 is opened or closed according to changes of air pressures inside and outside the detergent additive box 1.

Two air vents 211 are provided on the ventilation element 21, and passes through the upper and lower end faces of the ventilation element 21. Air outlets of the air vents are uniformly circumferentially distributed on the lower end face.

The ventilation element 21 is composed of two integrated coaxial cylindrical structures having different diameters, and the diameter of the upper end face is slightly greater than that of the lower end face.

A connection hole 212 connected to the opening and closing element 22 and a ring groove 213 assisting in sealing the opening and closing element 22 are also coaxially arranged on the ventilation element 21.

The connection hole 212 passes through the ventilation element 21, and is coaxial with the ventilation element 21. The connection hole 212 comprises two coaxial holes having different diameters. A locking boss 2121 for clamping the opening and closing element 22 is formed at a joint of the two holes. The air vents 211 are uniformly circumferentially arranged around an axis of the connection hole 212.

The ring groove 213 is formed in the lower end face of the ventilation element 21. The air outlets of the air vents 211 are formed in the lower end face within the ring groove 213. The inner side wall of the ring groove 213 tilts towards the air vents 211, and extends to outer edges of the air vents 211 in a transition manner. The outer side wall of the ring groove 213 is a vertical edge, and the two side walls are in smooth intersection.

The opening and closing element 22 is an integrated elastic material element, and comprises the opening and closing portion 221 and a connection portion 222. The opening and closing portion 221 is an inverted umbrella-shaped structure, which covers the lower end face of the ventilation element 21, and its tail end inserts into the ring groove 213.

When the opening and closing portion 221 is closed, the tail end of the opening and closing portion inserts into the ring groove 213 to seal the air vents 211. When the opening and closing portion 221 is opened, the opening and closing portion 221 deforms, with the tail end leaving the ring groove 213, and the air vents 211 implement ventilation in one way.

The connection portion 222 is provided with a ring convex plate 2221 and a transition section 2222. The ring convex plate 2221 cooperates with the locking boss 2121 on the connection hole 212 to clamp the connection portion 222 in the connection hole 212. The transition section 2222 is arranged between the ring convex plate 2221 and the opening and closing portion 221. A hollow hole 2223 assisting in the deformation of the opening and closing portion 221 is arranged in the transition section 2222.

Preferably, the ring convex plate 2221 has a semicircular cross section. The hollow hole 2223 formed inside the transition section 2222 extends and passes through the opening and closing portion 221 to further reduce the force for the deformation of the opening and closing portion 221.

The detergent additive box 1 in the present embodiment comprises the liquid outlet 12, and further comprises the above-mentioned one-way ventilation valve 2. The detergent additive box 1 has two states. In the first state, a detergent additive is pumped from the liquid outlet 12, so air pressure in the detergent additive box 1 is reduced to be less than external air pressure and the opening and closing portion 221 deforms, with the tail end leaving the ring groove 213, and air flows in through the air vents 211. In the second state, when the pumping is stopped, the liquid outlet 12 is sealed, so the air pressure in the detergent additive box 1 is equal to the external air pressure, and the opening and closing portion 221 restores the original shape, with the tail end inserting into the ring groove 213 to seal the detergent additive box 1.

Embodiment VI

As show in FIGS. 12 to 15, in the present embodiment, the detergent additive box 1 is provided with a liquid inlet cover 2', and the liquid inlet cover 2' comprises a box body and a liquid inlet 14. One liquid inlet cover 2' is detachably arranged at the liquid inlet 14. The liquid inlet cover 2' is a one-way ventilation structure.

The one-way ventilation structure comprises a cover body and an opening and closing element 22'. Two air vents 211' are provided on the cover body. The opening and closing element 22' comprises an opening and closing portion 221'. When the opening and closing portion 221' is opened or closed according to changes of air pressures inside and outside the detergent additive box 1, the air vents 211' implement ventilation in one way or are closed.

At least one air vent 211' is provided on the cover body, and passes through the upper and lower end surfaces of the cover body. Air outlets of the air vents 211' are uniformly circumferentially distributed on the lower end face.

The cover body comprises a first cover body 21' for rigid supporting and a second cover body 23' for flexible sealing. The second cover body 23' is sleeved at the lower end of the first cover body 21' and cooperates with the first cover body 21' to detachably hermetically mount the liquid inlet cover 2' at the liquid inlet 14.

The first cover body 21' and the second cover body 23' are made of two materials, and are in clamping molding.

The first cover body 21' is composed of two cylindrical structures having different diameters. The diameter of the upper end is greater than that of the lower end. The second cover body 23' is sleeved at the lower end of the first cover body 21'. The diameter of the upper end of the first cover body 21' is greater than that of the second cover body 23'.

The side wall of the second cover body 23' is provided with a groove 231' for clamping the liquid inlet 14 of the box body, and a transition portion 232' is arranged on the outer side of the bottom of the second cover body 23' for easy to assemble.

The groove 231' is matched with the liquid inlet 14 to hermetically clamp the liquid inlet cover 2' to the liquid inlet 14, and the transition portion 232' for easy to assemble arranged on the outer side of the bottom of the second cover body 23' is a slope extending from the bottom to the outside.

A recess 214' suitable for being held is arranged at the bottom of the side wall of the upper end of the first cover body 21', and is a tilting planar recess 214' from the side wall of the first cover body 21' to the bottom.

The second cover body 23' is an integrated elastic material element. A non-smooth connection portion 215' is arranged at the lower end of the first cover body 21'. The connection portion 215' is matched with the second cover body 23' to enhance the connection strength of the first cover body 21' and the second cover body 23'.

Two air vents 211' passing through the upper and lower end surfaces are formed in the first cover body 21', and a connection hole 212' connected with the opening and closing element 22' and a ring groove 213' assisting in sealing the opening and closing element 22' are also coaxially formed in the first cover body 21'. The ring groove 213' is arranged on the lower end face of the first cover body 21', and air outlets of the air vents 211' are formed in the lower end face within the ring groove 213'.

The air outlets of the air vents 211' are uniformly circumferentially distributed on the lower end face.

The connection hole 212' and the ring groove 213' are coaxially arranged, and the air vents 211' are uniformly circumferentially arranged around an axis of the connection hole 212'.

A locking boss 2121' for clamping the opening and closing element 22' is formed in the connection hole 212'.

Preferably, the inner side wall of the ring groove 213' tilts towards the air vents 211'. More preferably, the inner side wall of the ring groove 213' extends to outer edges of the air vents 211' in a tilting transition manner, thereby enhancing the sealing effect on the opening and closing portion 221'.

A recess 15 for mounting the liquid inlet cover 2' and a digging position 16 are arranged on the box body. The recess 15 extends from the liquid inlet 14 to the outside, and has a shape matched with the upper end of the first cover body 21'. The digging position 16 is a semicircular recess 15 additionally extending to the outside from one end of the recess 15. A guide portion 141 favorable for mounting the liquid inlet cover 2' is also arranged at the liquid inlet 14, and is matched with the transition portion 232' of the second cover body 23'.

The opening and closing element 22' is an integrated elastic material element, and comprises the opening and closing portion 221' and a connection transition section 222' connected with the connection hole 212' of the first cover body 21'.

The opening and closing portion 221' is an inverted umbrella-shaped structure or a conical structure, and covers the lower end face of the first cover body 21', and keeps the original shape on its own or deforms to make its tail end extend into or leave the ring groove 213' to close or open the air vents 211'. A hollow hole 2223' assisting in the deformation of the opening and closing portion 221' is formed inside the connection transition section 222'.

The opening and closing portion 221' of the opening and closing element 22' is made of an elastic material, and the opening and closing portion 221' and the connection portion 215' are integrated. The opening and closing portion 221' is an inverted umbrella-shaped structure.

When the opening and closing portion 221' is closed, the tail end of the opening and closing portion extends into the ring groove 213' to seal the air vents 211'. When opened, the opening and closing portion 221' deforms, with the tail end leaving the ring groove 213', and the air vents 211' implement ventilation in one way.

The connection transition section 222' is provided with a ring convex plate 2221' and a transition section. The ring convex plate 2221' cooperates with a locking boss 2121' on the connection hole 212' to clamp the connection portion 215' into the connection hole 212'. The ring convex plate 2221' has a semicircular cross section, and the hollow hole 2223' formed inside the connection transition section 222' extends and passes through the opening and closing portion 221'.

The detergent additive box 1 with the liquid inlet cover 2' comprises the liquid outlet 12. The detergent additive box 1 has two states. In the first state, a detergent additive is pumped from the liquid outlet 12, so air pressure in the detergent additive box 1 is reduced to be less than external air pressure and the opening and closing portion 221' deforms, with its tail end leaving the ring groove 213', and air flows in through the air vents 211'. In the second state, when the pumping is stopped, the liquid outlet 12 is sealed, so the air pressure in the detergent additive box is equal to the external air pressure, and the opening and closing portion 221' restores the original shape, with its tail end inserting into the ring groove 213' to seal the detergent additive box 1.

In the description of the present disclosure, it should be noted that unless otherwise explicitly defined and defined, the terms "installed" and "connected" are to be understood broadly, and may be, for example, fixedly connected, or detachably connected, or integrally connected, or mechanically connected, or electrically connected, or directly connected, or indirectly connected through an intermediate medium. Those of ordinary skill in the art can understand the specific meanings of the above terms in the present disclosure according to specific situations.

The above descriptions are only preferred embodiments of the present disclosure, but not intended to limit the present disclosure in any forms. Although the present disclosure is disclosed above by the preferred embodiments, the preferred embodiments are not intended to limit the present disclosure. Any person skilled in the art can make some changes by using the above-mentioned technical contents or modify the technical contents as equivalent embodiments of equivalent changes without departing from the scope of the technical solution of the present disclosure. Any simple alterations, equivalent changes and modifications that are made to the above embodiments according to the technical essence of the present disclosure without departing from the contents of the technical solution of the present disclosure shall all fall within the scope of the solution of the present disclosure.

The invention claimed is:

1. A distribution box of a washing machine, comprising:

at least one detergent additive box, each detergent additive box is a closed box structure having a cavity for accommodating a detergent additive and is provided with a one-way ventilation valve and a liquid outlet and an on-off valve arranged on the liquid outlet;

a mounting cavity for placing the at least one detergent additive box;

an upper-layer box and a lower-layer box, wherein the upper-layer box and the lower-layer box are detachably arranged or integrated, the lower-layer box connected with a diversion structure configured to communicate with an outer drum of the washing machine, the mounting cavity arranged on the upper-layer box; and a bottom wall of the mounting cavity has a through hole communicating with the lower-layer box, wherein the distribution box is configured to be withdrawn from and pushed into a water box of the washing machine.

2. The distribution box of the washing machine according to claim 1, wherein the liquid outlet is configured to communicate with an inlet of a feeding pipeline in the water box to deliver the detergent additive into the washing machine;

an opening is formed in a position, corresponding to the liquid outlet, of a side wall of the mounting cavity; and the inlet of the feeding pipeline is connected to the liquid outlet when the distribution box is pushed into the water box of the washing machine.

3. The distribution box of the washing machine according to claim 1, comprising:

a single-use feeding chamber arranged on the upper-layer box; and a siphon structure arranged in the single-use feeding chamber.

4. The distribution box of the washing machine according to claim 3, wherein the single-use feeding chamber is adjacent to the mounting cavity; and an open end of the single-use feeding chamber is provided with a feeding funnel;

an outlet of the feeding funnel is opposite to an opening of the single-use feeding chamber.

5. The distribution box of the washing machine according to claim 3, comprising:

a siphon cap integrally arranged at the bottom of the feeding funnel;

a siphon column integrally arranged at a position, corresponding to the siphon cap, in the single-use feeding chamber; and a diversion structure arranged at a position, corresponding to an outlet of the siphon column, on the lower-layer box.

6. The distribution box of the washing machine according to claim 1, comprising:

a washing powder adding chamber arranged on the upper-layer box;

a diversion plate arranged in the washing powder adding chamber, the diversion plate obliquely extends from one side wall of the washing powder adding chamber to an opposite side wall; and a portion, corresponding to a tail end of the diversion plate, of the bottom wall of the washing powder adding chamber is provided with a washing powder outlet communicating with the lower-layer box.

7. The distribution box of the washing machine according to claim 1, comprising:

a limiting structure arranged on the mounting cavity for limiting movement of the detergent additive box when the detergent additive box is placed in the mounting cavity.

8. The distribution box of the washing machine according to claim 7, wherein the limiting structure comprises an elastic member arranged on one side of the mounting cavity, and the elastic member is arranged between the detergent additive box and a side wall of the mounting cavity in an elastic deformation manner when the detergent additive box is placed in the mounting cavity.

9. The distribution box of the washing machine according to claim 8, wherein the at least one detergent additive box is a plurality of detergent additive boxes, and are parallel disposed to each other in the mounting cavity;

the limiting structure includes at least one separation rib arranged on a bottom wall of the mounting cavity for separating the detergent additive boxes.

10. The distribution box of the washing machine according to claim 1, wherein the through hole is adjacent to the liquid outlet.

11. The distribution box of the washing machine according to claim 4, comprising:

a siphon cap integrally arranged at the bottom of the feeding funnel;

a siphon column integrally arranged at a position, corresponding to the siphon cap, in the single-use feeding chamber; and a diversion structure is arranged at a position, corresponding to an outlet of the siphon column, on the lower-layer box.

12. The distribution box of the washing machine according to claim 3, comprising:

a washing powder adding chamber arranged on the upper-layer box;

a diversion plate arranged in the washing powder adding chamber, the diversion plate obliquely extends from one side wall of the washing powder adding chamber to an opposite side wall; and a portion, corresponding to a tail end of the diversion plate, of the bottom wall of the washing powder adding chamber is provided with a washing powder outlet communicating with the lower-layer box.

13. The distribution box of the washing machine according to claim 4, comprising:

a washing powder adding chamber arranged on the upper-layer box;

a diversion plate arranged in the washing powder adding chamber, the diversion plate obliquely extends from one side wall of the washing powder adding chamber to an opposite side wall; and a portion, corresponding to a tail end of the diversion plate, of the bottom wall of the washing powder adding chamber is provided with a washing powder outlet communicating with the lower-layer box.

14. The distribution box of the washing machine according to claim 5, comprising:

a washing powder adding chamber arranged on the upper-layer box;

a diversion plate arranged in the washing powder adding chamber, the diversion plate obliquely extends from one side wall of the washing powder adding chamber to an opposite side wall; and a portion, corresponding to a tail end of the diversion plate, of the bottom wall of the washing powder adding chamber is provided with a washing powder outlet communicating with the lower-layer box.

15. The distribution box of the washing machine according to claim 2, comprising:

a limiting structure arranged on the mounting cavity for limiting movement of the detergent additive box when the detergent additive box is placed in the mounting cavity.

16. The distribution box of the washing machine according to claim 5, comprising:

a limiting structure arranged on the mounting cavity for limiting movement of the detergent additive box when the detergent additive box is placed in the mounting cavity.

17. The distribution box of the washing machine according to claim 9, wherein the separation rib and the elastic member are arranged in the same direction; the separation rib limits the movement of the detergent additive box in a first direction, and the elastic member limits the movement of the detergent additive box in a second direction perpendicular to the first direction.

* * * * *